US008114475B2

(12) United States Patent
Thomas

(10) Patent No.: US 8,114,475 B2
(45) Date of Patent: Feb. 14, 2012

(54) ADSORBENTS FOR SMOKING ARTICLES COMPRISING A NON-VOLATILE ORGANIC COMPOUND APPLIED USING A SUPERCRITICAL FLUID

(75) Inventor: Charles Thomas, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 192 days.

(21) Appl. No.: 12/501,049

(22) Filed: Jul. 10, 2009

(65) Prior Publication Data

US 2009/0272391 A1 Nov. 5, 2009

Related U.S. Application Data

(62) Division of application No. 10/202,891, filed on Jul. 26, 2002, now abandoned.

(51) Int. Cl.

| | |
|---|---|
| ***B05D 7/00*** | (2006.01) |
| ***B05D 7/24*** | (2006.01) |
| ***A24D 3/08*** | (2006.01) |
| ***A24D 3/02*** | (2006.01) |

(52) U.S. Cl. ..... 427/212; 427/213.3; 131/331; 131/332; 131/280

(58) Field of Classification Search ..... None
See application file for complete search history.

(56) References Cited

U.S. PATENT DOCUMENTS

| | | | | |
|---|---|---|---|---|
| 3,008,474 A | * | 11/1961 | Touey et al. | 131/342 |
| 3,091,550 A | | 5/1963 | Doying | |
| 3,217,715 A | * | 11/1965 | Berger et al. | 131/342 |
| 3,236,244 A | | 2/1966 | Irby, Jr. et al. | |
| 3,394,709 A | | 7/1968 | Remer | |
| 3,426,765 A | | 2/1969 | Misenheimer | |
| 3,652,461 A | | 3/1972 | Dalton | |
| 3,658,070 A | * | 4/1972 | Diluzio | 131/334 |
| 3,716,063 A | | 2/1973 | Litzinger | |
| 3,972,335 A | | 8/1976 | Tiggelbeck et al. | |
| 4,062,368 A | | 12/1977 | Crellin et al. | |

(Continued)

FOREIGN PATENT DOCUMENTS

JP 2001-031413 2/2001

(Continued)

OTHER PUBLICATIONS

Written Opinion for International Application No. PCT/US03/23108 dated May 28, 2004.

(Continued)

*Primary Examiner* — Jason L. Lazorcik
(74) *Attorney, Agent, or Firm* — Buchanan Ingersoll & Rooney PC

(57) ABSTRACT

A surface-modified adsorbent and a process for making a surface-modified adsorbent are provided. The process involves providing an adsorbent and a non-volatile organic compound to a vessel, adjusting the temperature and/or pressure to provide supercritical conditions for a supercritical fluid, and introducing the supercritical fluid into the vessel. The supercritical fluid dissolves the non-volatile organic compound, and impregnates the adsorbent with the non-volatile organic compound. The surface-modified adsorbent can be used, for example, in cut filler compositions, cigarette filters, and smoking articles. Methods for making cigarette filters, cigarettes and for smoking a cigarette comprising the surface-modified adsorbent are also provided. The surface-modified adsorbents can be used to remove one or more selected components from mainstream smoke, without removing other components, such as those that contribute to flavor.

12 Claims, 4 Drawing Sheets

Carbon Modified By SF CO2-applied Squalene

U.S. PATENT DOCUMENTS

| | | | | | |
|---|---|---|---|---|---|
| 4,163,452 | A | | 8/1979 | Green et al. | |
| 4,756,319 | A | | 7/1988 | Takanashi | |
| 5,035,921 | A | * | 7/1991 | Berneburg et al. | 427/226 |
| 5,238,470 | A | | 8/1993 | Tolles et al. | |
| 5,292,706 | A | | 3/1994 | Chang et al. | |
| 5,322,075 | A | | 6/1994 | Deevi et al. | |
| 5,403,621 | A | * | 4/1995 | Jackson et al. | 427/255.39 |
| 5,416,056 | A | | 5/1995 | Baker | |
| 5,435,325 | A | | 7/1995 | Clapp et al. | |
| 5,461,023 | A | * | 10/1995 | Chang et al. | 502/418 |
| 5,497,792 | A | | 3/1996 | Prasad et al. | |
| 5,499,636 | A | | 3/1996 | Baggett et al. | |
| 5,591,368 | A | | 1/1997 | Fleischhauer et al. | |
| 5,666,976 | A | | 9/1997 | Adams et al. | |
| 5,692,525 | A | | 12/1997 | Counts et al. | |
| 5,692,526 | A | | 12/1997 | Adams et al. | |
| 5,705,269 | A | | 1/1998 | Pimenov et al. | |
| 5,746,230 | A | | 5/1998 | Arterbery et al. | |
| 5,915,387 | A | | 6/1999 | Baggett et al. | |
| 5,934,289 | A | | 8/1999 | Watkins et al. | |
| 5,988,176 | A | | 11/1999 | Baggett et al. | |
| 6,026,820 | A | | 2/2000 | Baggett et al. | |
| 6,053,176 | A | | 4/2000 | Adams et al. | |
| 6,117,810 | A | | 9/2000 | Lee et al. | |
| 6,121,179 | A | | 9/2000 | McBrayer et al. | |
| 6,194,650 | B1 | * | 2/2001 | Wakayama et al. | 136/256 |
| 7,713,581 | B2 | * | 5/2010 | Heidlas et al. | 427/212 |
| 2004/0226569 | A1 | | 11/2004 | Yang et al. | |

FOREIGN PATENT DOCUMENTS

| | | | |
|---|---|---|---|
| WO | WO 0220177 | A1 * | 3/2002 |

OTHER PUBLICATIONS

Notification of Transmittal of the International Search Report or the Declaration for PCT/US03/23108 dated Oct. 6, 2003.

Translation of Japanese Patent Application No. 2001-31413, Published Feb. 6, 2001.

Translation of Japanese Patent Application No. 07-1444121, Published Jun. 6, 1995.

* cited by examiner

ADSORBENTS FOR SMOKING ARTICLES COMPRISING A NON-VOLATILE ORGANIC COMPOUND APPLIED USING A SUPERCRITICAL FLUID

CROSS-REFERENCE TO RELATED APPLICATIONS

This application is a divisional application of U.S. Application No. 10/202,891 entitled ADSORBENTS FOR SMOKING ARTICLES COMPRISING A NON-VOLATILE ORGANIC COMPOUND APPLIED USING A SUPERCRITICAL FLUID, filed on Jul. 26, 2002 now abandoned, the entire content of which is hereby incorporated by reference.

FIELD OF INVENTION

The invention relates generally to surface-modified adsorbents comprising a non-volatile organic compound, applied to an appropriate substrate using a supercritical fluid, and processes for producing same. More specifically, the invention relates to the use of a surface-modified adsorbent for filters, in particular for the selective filtration of selected components from mainstream smoke, i.e. in a cigarette.

BACKGROUND

Cigarette filters, incorporating various materials that mechanically, chemically and/or physically remove components of mainstream cigarette smoke have the disadvantage of non-selectively filtering components from mainstream smoke, even those components that contribute to flavor. The result may be a cigarette with an unsatisfactory taste.

For instance, carbon has been used to filter various components from mainstream smoke. Several modified forms of activated carbon has also been described, for example, in U.S. Pat. Nos. 5,705,269; 4,062,368; 3,652,461; 3,217,715; and 3,091,550. In addition, U.S. Pat. No. 6,117,810 describes activated carbon having zeolite salts crystallized in the pores. However, achieving the desired selectivity can be difficult. In addition, the production of such modified activated carbon typically requires additional processing steps, such as coating the activated carbon with solutions, filtration, drying and/or crystallization. Further, such methods are generally unsuitable to effectively impregnate the adsorbent material, and thus do not penetrate the pores or interior surfaces.

Thus, despite various developments in adsorbent and filtration materials, what is needed in the art are effective and inexpensive means for producing modified adsorbents, particularly those suitable for use in smoking articles and cigarette filters. Preferably, such adsorbents should preferentially remove selected components from mainstream tobacco smoke, while maintaining other components, such as those that contribute to flavor, for example. In particular, such adsorbent materials should preferentially adsorb selected components such as acrolein, hydrogen cyanide and acrylonitrile.

SUMMARY

In one embodiment, the invention relates to a process for making a surface-modified adsorbent. The process comprises (i) providing at least one adsorbent and at least one non-volatile organic compound to a vessel; (ii) adjusting temperature and/or pressure to provide supercritical conditions in said vessel for a supercritical fluid; and (iii) introducing the supercritical fluid into the vessel, such that the supercritical fluid dissolves the non-volatile organic compound, and wherein the supercritical fluid with the dissolved non-volatile organic compound impregnates the adsorbent to form a surface-modified adsorbent. Another embodiment of the invention relates to the surface-modified adsorbent produced by this process.

In another embodiment, the invention relates to a smoking article comprising the surface-modified adsorbent described above. A preferred smoking article is a cigarette. The surface-modified adsorbent is dispersed in smoking material and/or is located in a filter. Preferably, the smoking article comprises from about 10 mg to about 200 mg of the surface-modified adsorbent.

In another embodiment, the invention relates to a cigarette filter comprising the surface-modified adsorbent described above. Preferably, the cigarette filter comprises from about 10 mg to about 200 mg of the surface-modified adsorbent. In yet another embodiment, the invention relates to a cut filler composition comprising the surface-modified adsorbent described above.

Preferably, the adsorbent used in the invention is selected from the group consisting of: adsorbent carbon, activated carbon, silica gel, alumina, polyester resins, zeolite, and mixtures thereof, with activated carbon being particularly preferred. Preferably, the activated carbon has an average particle size from about 0.2 mm to about 1 mm.

Preferably, the supercritical fluid is selected from the group consisting of: carbon dioxide, n-propane, n-butane, n-pentane, n-hexane, n-heptane, cyclohexane, ethanol, toluene, acetone, methyl acetate, diethyl ether, dichloromethane, dichlorodifluoromethane, trifluoromethane, carbon tetrachloride and mixtures thereof, with carbon dioxide being particularly preferred.

Preferably, the non-volatile organic compound is selected from the group consisting of: alkenes, alkynes, aldehydes, ethers, amides, esters, fatty acids, fatty acid esters, and mixtures thereof, with squalene, squalane, phytol, sucrose octapalmitic acid ester, and mixtures thereof being particularly preferred. In a preferred embodiment, the non-volatile compound is capable of blocking pores in the adsorbent having an average size greater than about 20 Angstroms, and more preferably the non-volatile compound is capable of blocking pores in the adsorbent having an average size greater than about 10 Angstroms.

An embodiment of the invention also relates to a method of making a cigarette filter, said method comprising: (i) providing a surface-modified adsorbent as described above, and (ii) incorporating the surface-modified adsorbent into a cigarette filter.

Another embodiment of the invention relates to a method of making a cigarette, said method comprising: (i) providing a cut filler to a cigarette making machine to form a tobacco rod; (ii) placing a paper wrapper around the tobacco rod; (iii) providing a cigarette filter comprising a surface-modified adsorbent as described above; and (iv) attaching the cigarette filter to the tobacco rod to form the cigarette. In yet another embodiment, the invention relates to a method of making a cigarette, said method comprising: (i) adding a surface-modified adsorbent as described above to a cut filler; (ii) providing the cut filler comprising the surface-modified adsorbent to a cigarette making machine to form a tobacco rod; and (iii) placing a paper wrapper around the tobacco rod to form the cigarette.

In yet another embodiment of the invention is provided a method of smoking a smoking article that comprises a surface-modified adsorbent as described above, said method comprising lighting the smoking article to form smoke and inhaling the smoke, wherein during the smoking of the cigarette, the surface-modified adsorbent preferentially removes one or more selected components from mainstream smoke.

BRIEF DESCRIPTION OF THE DRAWINGS

Various features and advantages of the invention will become apparent from the following detailed description of the preferred embodiments thereof in connection with the accompanying drawings, in which.

DETAILED DESCRIPTION

Figure 1:
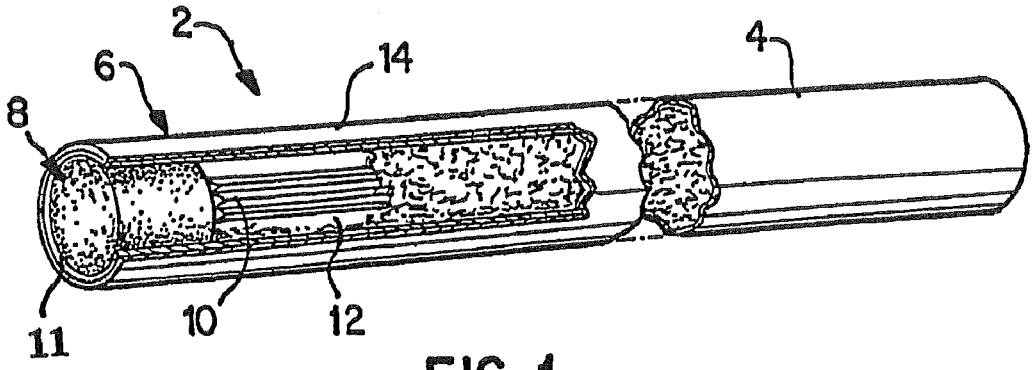
FIG. 1 is a partially exploded perspective view of a cigarette incorporating one embodiment of the present invention wherein folded paper containing the surface-modified adsorbent is inserted into a hollow portion of a tubular filter element of the cigarette.

The invention provides a process for making a surface-modified adsorbent, where a non-volatile organic compound is applied to an adsorbent using a supercritical fluid. The invention also relates to the surface-modified adsorbent produced by this process, as well as smoking articles, cigarette filters, cut filler compositions and methods which incorporate the surface-modified adsorbent.

The surface-modified adsorbent can be used as a filtration agent. In particular, the surface-modified adsorbents of the invention could be used as filters for a smoking article to preferentially remove one or more selected components from mainstream smoke, while retaining other components, such as those components that contribute to flavor. The term "mainstream" smoke includes the mixture of gases passing down the tobacco rod and issuing through the filter end, i.e. the amount of smoke issuing or drawn from the mouth end of a smoking article during smoking of the smoking article. The mainstream smoke contains smoke that is drawn in through the lit region of the smoking article, possibly diluted by air that is drawn in through the paper wrapper.

The surface-modified adsorbent is made by the following process, where a supercritical fluid is used to dissolve a non-volatile organic compound and impregnate the adsorbent with the non-volatile organic compound. In the process, at least one adsorbent and at least one non-volatile organic compound are provided to a vessel. The temperature and/or pressure conditions are adjusted to provide supercritical conditions in the vessel for whichever supercritical fluid or mixture of supercritical fluids is to be used. The supercritical fluid is introduced into the vessel, and dissolves the non-volatile organic compound. By "dissolved" is meant that the non-volatile organic compound is dispersed in the supercritical fluid. By "non-volatile" is meant that the organic compound will not pass into the vapor state and will remain a solid or liquid at standard temperature and pressure.

The supercritical fluid carrying the dissolved non-volatile organic compound impregnates the adsorbent, preferably carrying the non-volatile organic compound into the pores of the adsorbent. While it is not possible to penetrate the small pores of many adsorbents using typical coating methods with solutions, supercritical fluids have the benefit of having densities and diffusivities similar to liquids but viscosities comparable to gases, thereby permitting the non-volatile organic compound to permeate the pores of the adsorbent, in a manner which could not otherwise be achieved using conventional methods.

Moreover, in a preferred embodiment, when the supercritical conditions are removed the supercritical fluid will simply sublime or vaporize, thus leaving behind a surface-modified adsorbent, which does not require further purification steps. Since the organic compound is non-volatile, it will not evaporate or move from the location where the supercritical fluid carried it, i.e. into the pores of the adsorbent.

Typical adsorbents include any material that has the ability to condense or hold molecules of other substances on its surface. While not wishing to be bound by theory, adsorption is mainly caused by London Dispersion Forces, a type of Van der Waals force, which exists between molecules. The forces act within extremely short ranges, and are additive. In gas phase adsorption, molecules are condensed from the bulk phase within the pores of the activated carbon. The driving force for adsorption is the ratio of the partial pressure and the vapor pressure of the compound. In liquid or solid phase adsorption the molecules go from the bulk phase to being adsorbed in the pores in a semi-liquid or solid state.

Examples of adsorbents include adsorbent carbon, activated carbon, silica gel, alumina, polyester resins, zeolite, and mixtures thereof. Such adsorbents may be manufactured or prepared using any suitable technique known in the art, or may be purchased from commercial suppliers.

While even charcoal or graphite have some ability to adsorb molecules, activated carbon is particularly preferred as an adsorbent because activated forms of carbon generally have stronger physical adsorption forces, and higher volumes of adsorbing porosity.

A particularly preferred activated carbon is commercially available from PICA USA, Inc., Truth or Consequences, N. Mex. The activated carbon could also be manufactured by any suitable method known in the art. Such methods include the carbonization of coconut husk, coal, wood, pitch, cellulose fibers, or polymer fibers, for example. Carbonization is usually carried out at high temperatures, i.e. 200-800° C. in an inert atmosphere, followed by activation under reduced conditions. The activated carbon produced could be in the form of granules, beads, monoliths, fragments, powder or fibers.

In a preferred embodiment, granulated carbon typically having particles ranging in size from 0.1 mm to about 5 mm is used, or pelleted carbon having particles ranging in size from 0.5 mm to about 5 mm is used. In a most preferred embodiment, carbon particles ranging in size from about 0.2 to 1 mm are used. In terms of Tyler screen mesh size, the carbon particles are preferably from about 6 mesh to about 300 mesh, preferably 10 to 70 mesh, and more preferably from about 14 to 35 mesh.

Carbon particles also have a distribution of micropores, mesopores and macropores. The term "microporous" generally refers to such materials having pore sizes of about 15 Å or less while the term "mesoporous" generally refers to such materials with pore sizes of about 15-300 Å. In a preferred embodiment, the proportion of micropores to mesopores will be about 50:40. In a most preferred embodiment, the pores of the activated carbon comprise at least 80% micropores. The relative amounts of ratio of micropores, mesopores and macropores will depend upon the selected components from mainstream tobacco smoke that are to be targeted and removed. Thus, the pore sizes and pore distribution can be adjusted accordingly as needed for a certain application.

Another preferred material, which may be used as the adsorbent is a zeolite. A zeolite is a porous crystalline material predominantly comprised of aluminosilicate. Zeolite pores may be more or less uniform and may have pore dimensions over a range of sizes; the material may further comprise additional metals and metal oxides. Synthetic zeolite materials may have more uniform pore dimensions and a more ordered structure. Phosphate-containing aluminosilicate analogs of zeolites are also known. Various zeolite types are described, for example, in U.S. Pat. No. 3,702,886 (zeolite ZSM-5), U.S. Pat. No. 2,882,243 (zeolite A), U.S. Pat. No. 2,882,244 (zeolite X), 3,130,007 (zeolite Y), U.S. Pat. No. 3,055,654 (zeolite K-G), U.S. Pat. No. 3,247,195 (zeolite ZK-5), U.S. Pat. No. 3,308,069 (zeolite Beta), U.S. Pat. No. 3,314,752 (zeolite ZK-4). A source of natural zeolite in North America is the St. Cloud Mining Company, Truth or Consequences, N. Mex. Preferred zeolite materials include ZSM-5, Y-type zeolite and clinoptilolite.

The adsorbent should be selected to have a sufficient surface area to preferentially adsorb selected components from cigarette smoke. While surface area is inversely proportional to particle size, adsorbents having small particle size may pack together too densely to permit mainstream smoke to flow through the filter during smoking. If particle size is too large, there will be insufficient surface area. Therefore, these factors should be considered in selecting an absorbent having a particular particle size.

The non-volatile organic component may further act as a "solvent" to dissolve mainstream smoke components of the appropriate solubility characteristics. The non-volatile organic compound may be selected from organic compounds which effectively react and immobilize selected components in mainstream smoke, i.e. by ion exchange, hydrophobic interactions, chelation, and/or chemically binding. Alternatively, the non-volatile organic compound may block certain pores of the adsorbent thereby adjusting the ability of the adsorbent to only adsorb components of a particular size.

Suitable non-volatile organic compounds include, but are not limited to: alkenes, alkynes, aldehydes, ethers, amides, esters, fatty acids, fatty acid esters, and mixtures thereof. Squalene, squalane, phytol, sucrose octa-palmitic acid ester, and mixtures thereof are particularly preferred. In a preferred embodiment, the non-volatile compound is capable of blocking pores in the adsorbent having an average size greater than about 20 Angstroms, and more preferably the non-volatile compound is capable of blocking pores in the adsorbent having an average size greater than about 10 Angstroms. One or more non-volatile compounds may be used to achieve a desired result. The amount of the non-volatile compound that is provided will be adjusted through routine experimentation, depending on the amount of non-volatile compound desired in the final surface-modified adsorbent.

The non-volatile organic compound or mixture of non-volatile organic compounds used in making the surface-modified adsorbent may be chosen to target selected components in mainstream smoke, and may be located either on the exterior and/or interior surfaces of the adsorbent, or may be embedded within pores of the adsorbent. The selection of adsorbent material and non-volatile organic compound permit the preferential removal of one or more selected components from mainstream smoke, while retaining other components, such as those relating to flavor. Usually components relating to flavor are of larger size and/or molecular weight, while smaller components, such as light gases, various aldehydes and small molecules may be targeted for removal. For example, in a preferred embodiment, pores on the adsorbent greater than a particular average size are blocked. However, the selectivity of the surface-modified adsorbent can be fine tuned, particularly by the selection of adsorbent material and non-volatile organic compound, as well the choice of supercritical fluid. Such optimization can be achieved using routine experimentation.

The supercritical fluid used in the invention may be any suitable supercritical fluid which dissolves the non-volatile organic compound under supercritical conditions. By supercritical conditions is meant temperatures and pressures where the solvent is in the supercritical state, i.e. in the gas phase at a sufficiently high temperature that it cannot be liquified by an increase in pressure. The critical temperatures and pressure can be determined by routine experimentation or reference to books such as the "CRC Handbook of Chemistry and Physics," $70^{th}$ Edition, R. C. Weast et al., Editors, CRC PRess, Inc., Boca Raton, Fla., 1989. Table A lists critical temperatures and critical pressures for several representative examples of fluids.

TABLE A

Critical Temperatures and Critical Pressures for Several Fluids

| Fluid | $T_c$ (° C.) | $P_c$ (atm.) |
|---|---|---|
| carbon dioxide | 31.3 | 72.9 |
| n-propane | 96.8 | 42 |
| n-butane | 152.0 | 37.5 |
| n-pentane | 196.6 | 33.3 |
| n-hexane | 234.2 | 29.9 |
| n-heptane | 267.1 | 27 |
| cyclohexane | 280.4 | 40 |
| ethanol | 243 | 63 |
| toluene | 320.8 | 41.6 |
| acetone | 235.5 | 47 |
| methyl acetate | 233.7 | 46.3 |
| diethyl ether | 192.6 | 35.6 |
| dichloromethane | 237 | 60 |
| dichlorodifluoromethane | 111.8 | 40.7 |
| trifluoromethane | 25.9 | 46.9 |
| carbon tetrachloride | 283.1 | 45 |

Supercritical fluids will preferably have densities and diffusivities similar to liquids but viscosities comparable to gases. For instance, preferred supercritical fluids will have densities from about 0.2-0.9 g/mL, viscosities from about $0.2\times10^{-3}$ to $1.0\times10^{-3}$ poise, and diffusivities from about $0.1\times10^{-4}$ to about $3.3\times10^{-4}$ $cm^2$/sec.

Suitable supercritical fluids that may be used include, but are not limited to: carbon dioxide, n-propane, n-butane, n-pentane, n-hexane, n-heptane, n-cyclohexane, n-hexanol, ethanol, n-pentanol, toluene, acetone, methyl acetate, diethyl ether, petroleum ethers, and halogenated hydrocarbons. Examples of halogenated hydrocarbons include, for example, dichloromethane, difluoroethane, dichlorodifluoromethane, trifluoromethane and carbon tetrachloride. Other suitable supercritical fluids or mixtures of supercritical fluids that dissolve the non-volatile organic compound may also be used.

In a preferred embodiment, supercritical carbon dioxide is used. Carbon dioxide is superfluid above its critical temperature, i.e. above about 31.3° C., and above its critical pressure, i.e. above about 70 atmospheres. Supercritical carbon dioxide is inexpensive and non-toxic. In addition, it may be modified, i.e. with HCl or $NH_3$, to make the solvent more acidic or basic in order, as needed to dissolve the non-volatile organic compound.

The length of time required to impregnate or form the surface-modified adsorbent may be determined by routine experimentation. Typical reaction times will generally be less than about 60 minutes, more preferably less than about 30 minutes, and most preferably less than about 15 minutes. For example, impregnation with carbon dioxide in the supercritical state is typically carried out at pressures from about 70 atmospheres to about 1500 atmospheres, and at temperatures in the range of from above about the critical temperature to about 120° C. for reaction times of about 15-20 minutes for most non-volatile organic compounds.

Any suitable vessel that is capable of maintaining supercritical conditions may be used. Such vessels are commercially available. For instance, most vessels used for supercritical fluid extraction may be used, with minor or no modifications.

The surface-modified adsorbents may be used in a variety of applications, including smoking articles, cut filler compositions and cigarette filters. Thus, in one embodiment, the invention relates to a smoking article comprising surface-modified adsorbents. The smoking article may be any article containing smokeable material, such as a cigarette, a pipe, a cigar and a non-traditional cigarette. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636. The surface-modified adsorbents may be located in a filter and/or dispersed in the smoking material itself. An amount effective to remove or lower the amount of one or more selected components in mainstream smoke is used. Typical smoking articles will include from about 10 mg to about 200 mg of the surface-modified adsorbents, although the amount needed can also be determined easily by routine experimentation and/or adjusted accordingly.

The invention further relates to cigarette filters comprising the surface-modified adsorbents. Any conventional or modified filter may incorporate the surface-modified adsorbents. In one embodiment, the surface-modified adsorbent is incorporated into or onto a support such as paper (e.g., tipping paper) that is located along a filter portion of a cigarette. As will be recognized by persons skilled in the art, such paper can be used, for example, as a wrapper or a liner in the filter portion of the cigarette. The surface-modified adsorbent can also be loaded onto a support such as lightly or tightly folded paper inserted into a hollow portion of the cigarette filter. The support is preferably in the form of a sheet material such as crepe paper, filter paper, or tipping paper. However, other suitable support materials such as organic or inorganic cigarette compatible materials can also be used.

FIG. 1 illustrates a cigarette 2 having a tobacco rod 4, a filter portion 6, and a mouthpiece filter plug 8. As shown, a surface-modified adsorbent can be loaded onto folded paper 10 inserted into a hollow cavity such as the interior of a free-flow sleeve 12 forming part of the filter portion 6.

Figure 2:
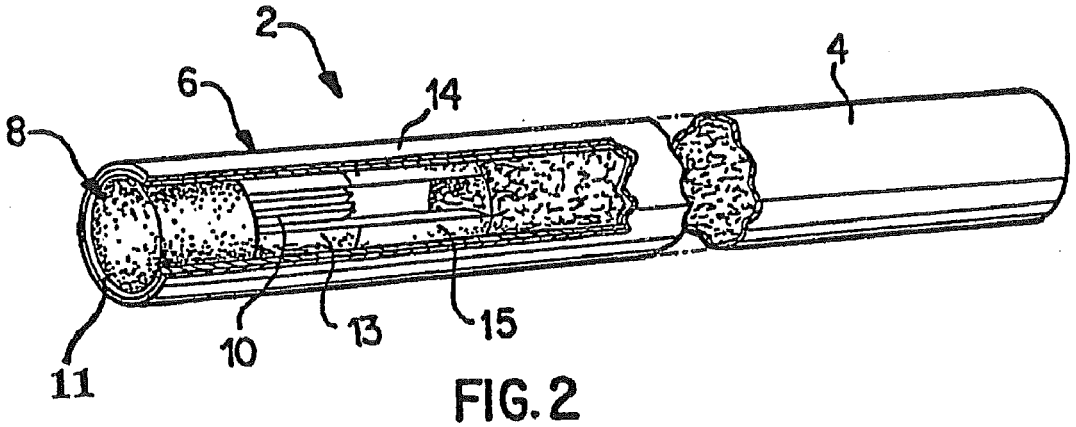
FIG. 2 is partially exploded perspective view of another embodiment of the present invention wherein the surface-modified adsorbent is incorporated in folded paper and inserted into a hollow portion of a first free-flow sleeve of a tubular filter element next to a second free-flow sleeve.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, a desired amount of surface-modified adsorbent can be provided in the cigarette filter portion by adjusting the amount of surface-modified adsorbent coated per unit area of the paper and/or the total area of coated paper employed in the filter (e.g., higher amounts of surface-modified adsorbent can be provided simply by using larger pieces of coated paper). In the cigarettes shown in FIGS. 1 and 2, the tobacco rod 4 and the filter portion 6 are joined together with tipping paper 14. In both cigarettes, the filter portion 6 may be held together by filter overwrap 11.

The surface-modified adsorbent can be incorporated into the filter paper in a number of ways. For example, the surface-modified adsorbent can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively, the surface-modified adsorbent is added to the filter paper during the paper-making process. For example, the surface-modified adsorbent can be mixed with bulk cellulose to form a cellulose pulp mixture. The mixture can be then formed into filter paper according to methods known in the art.

Figure 3:
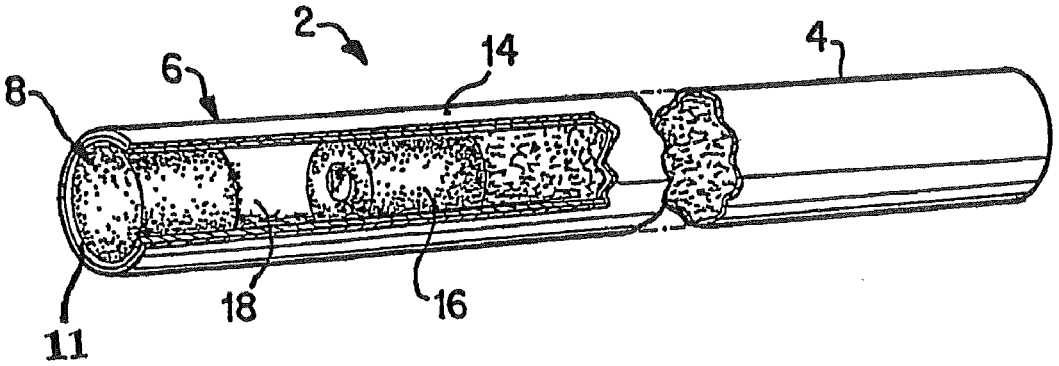
FIG. 3 is a partially exploded perspective view of another embodiment of the present invention wherein the surface-modified adsorbent is incorporated in a plug-space-plug filter element.

In another embodiment of the present invention, the surface-modified adsorbent is incorporated into the fibrous material of the cigarette filter portion itself. Such filter materials include, but are not limited to, fibrous filter materials including paper, cellulose acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 are joined together with tipping paper 14. The filter portion 6 may include a filter overwrap 11. The filter overwrap 11 containing traditional fibrous filter material and surface-modified adsorbent can be incorporated in or on the filter overwrap 11 such as by being coated thereon. Alternatively, the surface-modified adsorbent can be incorporated in the mouthpiece filter 8, in the plug 16, and/or in the space 18. Moreover, the surface-modified adsorbent can be incorporated in any element of the filter portion of a cigarette. For example, the filter portion may consist only of the mouthpiece filter 8 and the surface-modified adsorbent can be incorporated in the mouthpiece filter 8 and/or in the tipping paper 14.

Figure 4:
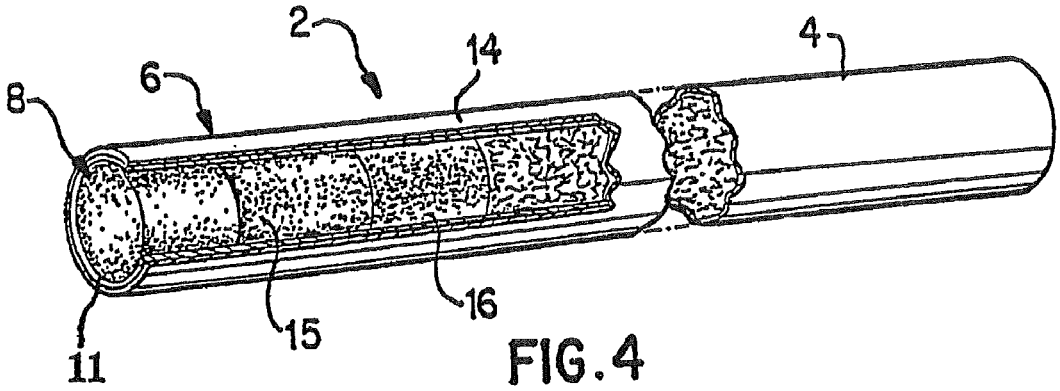
FIG. 4 is a partially exploded perspective view of another embodiment of the present invention wherein the surface-modified adsorbent is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of surface-modified adsorbents or a plug 15 made of material such as fibrous polypropylene or cellulose acetate containing the surface-modified adsorbent. As in the previous embodiment, the plug 16 can be hollow or solid and the tobacco rod 4 and filter portion 6 are joined together with tipping paper 14. There is also a filter overwrap 11.

Figure 5:
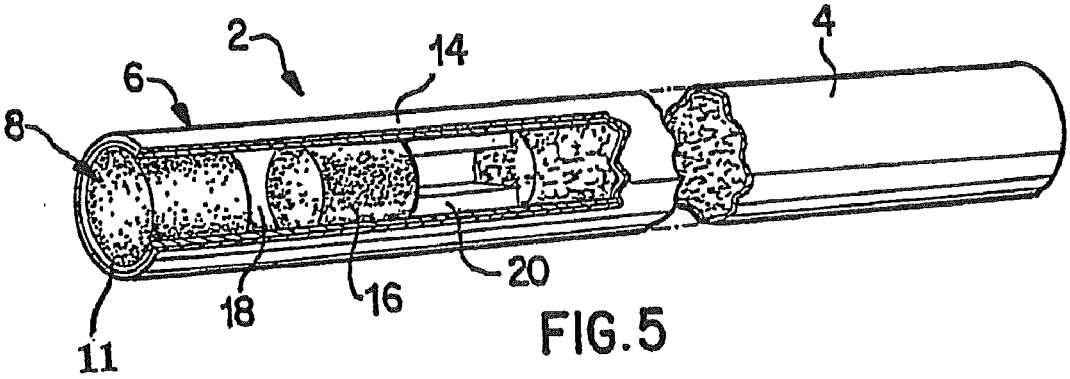
FIG. 5 is a partially exploded perspective view of another embodiment of the present invention wherein the surface-modified adsorbent is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. The surface-modified adsorbent can be incorporated into one or more elements of the filter portion 6. For instance, the surface-modified adsorbent can be incorporated into the sleeve 20 or granules of the surface-modified adsorbent can be filled into the space within the sleeve 20. If desired, the plug 16 and sleeve 20 can be made of material such as fibrous polypropylene or cellulose acetate containing surface-modified adsorbent. As in the previous embodiment, the plug 16 can be hollow or solid.

Figure 6:
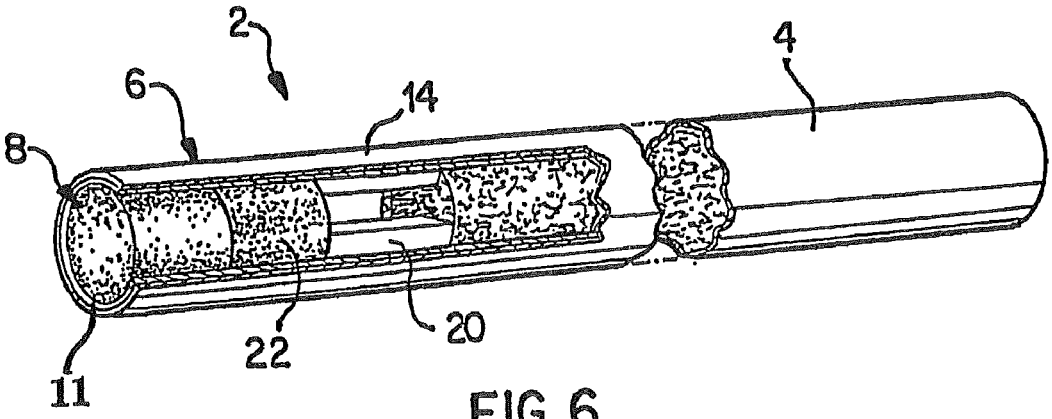
FIG. 6 is a partially exploded perspective view of another embodiment of the present invention wherein the surface-modified adsorbent is incorporated in a three-part filter element having two plugs and a hollow sleeve.
Figure 7:
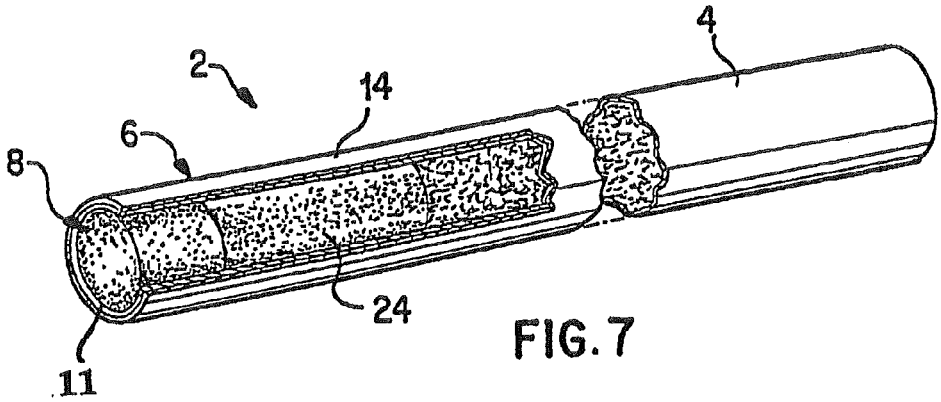
FIG. 7 is a partially exploded perspective view of another embodiment of the present invention wherein the surface-modified adsorbent is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and the surface-modified adsorbent can be incorporated in one or more of these filter elements. In FIG. 7, the filter portion 6 includes a mouthpiece filter 8 and a plug 24, and the surface-modified adsorbent can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply the surface-modified adsorbent to filter fibers or other substrate supports. For example, the surface-modified adsorbent can be added to the filter fibers before they are formed into a filter cartridge, e.g., a tip for a cigarette. The surface-modified adsorbent can be added to the filter fibers, for example, in the form of a dry powder or a slurry by methods known in the art. If the surface-modified adsorbent is applied in the form of a slurry (e.g., using a solvent that allows the organic impregnate to remain on the adsorbate), the fibers are allowed to dry before they are formed into a filter cartridge.

In another preferred embodiment, the surface-modified adsorbent is employed in a hollow portion of a cigarette filter. For example, some cigarette filters have a plug/space/plug configuration in which the plugs comprise a fibrous filter material and the space is simply a void between the two filter plugs. That void can be filled with the surface-modified adsorbent of the present invention. An example of this embodiment is shown in FIG. 3. The surface-modified adsorbent can be in granular form or can be loaded onto a suitable support such as a fiber or thread.

Figure 8:
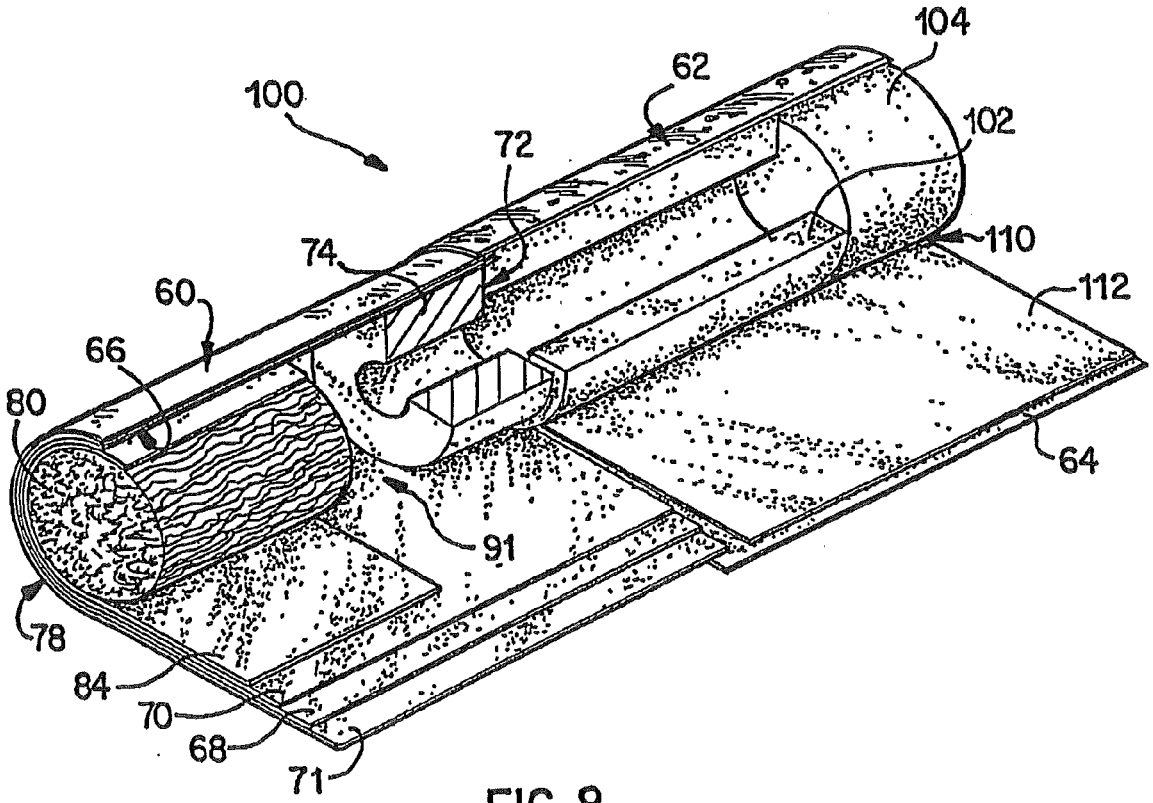
FIG. 8 is a partially exploded perspective view of another embodiment of the present invention wherein the surface-modified adsorbent is incorporated in a filter element which may be used in a smoking article.

In another embodiment of the present invention, the surface-modified adsorbent is employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating a surface-modified adsorbent of the invention.

In such a cigarette, a surface-modified adsorbent can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, the surface-modified adsorbent can be incorporated into the fibrous wall portions of the tubular free-flow filter element 102 itself. For instance, the tubular free-flow filter element or sleeve 102 can be made of suitable materials such as polypropylene or cellulose acetate fibers and the surface-modified adsorbent can be mixed with such fibers prior to or as part of the sleeve forming process.

In another embodiment, the surface-modified adsorbent can be incorporated into the mouthpiece filter plug 104 instead of in the element 102. However, as in the previously described embodiments, according to the invention, surface-modified adsorbents may be incorporated into more than one component of a filter portion such as by being incorporated into the mouthpiece filter plug 104 and into the tubular free-flow filter element 102.

The filter portion 62 of FIG. 8 can also be modified to create a void space into which the surface-modified adsorbent can be inserted.

As explained above, surface-modified adsorbents can be incorporated in various support materials. When the surface-modified adsorbent is used in filter paper, the particles may have an average particle diameter of 10 to 100 μm, preferably 40 to 50 μm. When the surface-modified adsorbent is used in filter fibers or other mechanical supports such as plug-type plug cavities, larger particles may be used. Such particles preferably have a Tyler screen mesh size from 10 to 60, and more preferably from 14 to 35 mesh.

The amount of surface-modified adsorbent employed in the cigarette filter by way of incorporation on a suitable support such as filter paper and/or filter fibers depends on the amount of constituents in the tobacco smoke and the amount of constituents desired to be removed. As an example, the filter paper and the filter fibers may contain from 10% to 50% by weight of the surface-modified adsorbent.

An embodiment of the invention relates to a method of making a cigarette filter, said method comprising: (i) providing a surface-modified adsorbent as described above, and (ii) incorporating the surface-modified adsorbent into a cigarette filter. Any conventional or modified methods for making a filter may be used to incorporate the surface-modified adsorbent.

Another embodiment of the invention relates to a method of making a cigarette, said method comprising: (i) providing a cut filler to a cigarette making machine to form a tobacco rod; (ii) placing a paper wrapper around the tobacco rod; (iii) providing a cigarette filter comprising a surface-modified adsorbent as described above; and (iv) attaching the cigarette filter to the tobacco rod to form the cigarette. In yet another embodiment, the invention relates to a method of making a cigarette, said method comprising: (i) adding a surface-modified adsorbent as described above to a cut filler; (ii) providing the cut filler comprising the surface-modified adsorbent to a cigarette making machine to form a tobacco rod; and (iii) placing a paper wrapper around the tobacco rod to form the cigarette.

Examples of suitable types of tobacco materials which may be used include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, humectants, combustion modifying agents, coloring agents, binders, etc.) known in the art.

Techniques for cigarette manufacture are known in the art, and may be used to incorporate the surface-modified adsorbent. The resulting cigarettes can be manufactured to any desired specification using standard or modified cigarette making techniques and equipment. The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 $mg/cm^3$ to about 300 $mg/cm^3$, and preferably 150 $mg/cm^3$ to about 275 $mg/cm^3$.

In yet another embodiment of the invention is provided a method of smoking a smoking article comprising a surface-modified adsorbent as described above, said method comprising lighting the smoking article to form smoke and inhaling the smoke, wherein during the smoking of the cigarette, the surface-modified adsorbent preferentially removes one or more selected components from mainstream smoke.

"Smoking" of a cigarette means the heating or combustion of the cigarette to form smoke, which can be inhaled. Generally, smoking of a cigarette involves lighting one end of the cigarette and inhaling the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,934,289, 5,591,368 or 5,322,075, for example.

The practice of the invention is further disclosed in the following examples, which should not be construed to limit the invention in any way.

EXAMPLES

In the following examples, three surface-modified adsorbents are prepared, and their adsorption profiles were studied. The adsorbent used in the experiments was Pica G-277 Carbon, which is commercially available from PICA USA, Inc., Truth or Consequences, N. Mex.

A. 10% squalene on Pica G-277 Carbon, Carbon Dioxide Treated

The surface-modified adsorbent was produced by placing in a sealable high pressure vessel 50 mg Pica G-277 carbon and 55 mg squalene (provided on a piece of filter paper). The vessel was pressurized to about 400 atmospheres at about 50° C. Supercritical carbon dioxide was introduced, which dissolved the squalene. The supercritical carbon dioxide with the dissolved squalene, then impregnated the carbon with the squalene. After about 15-20 minutes, the vessel was opened, and the supercritical fluid sublimed. The non-volatile squalene was present on the surface and within the pores of the activated carbon. The amount of squalene adsorbed on the carbon is determined by measuring the weight gain of the carbon before and after the experiment.

B. 10% Squalene on Pica G-277 Carbon, Hexane Treated

The surface-modified adsorbent was produced by coating 50 mg Pica G-277 carbon with a solution of squalene dissolved in hexane to deposit squalene on the surface of the carbon. The squalene coated carbon was heat treated at 60° C. to drive off the hexane and leave the squalene on the surface of the carbon. The coated carbon was placed in a sealable high pressure vessel pressurized to about 400 atmospheres at 50° C. and supercritical carbon dioxide was introduced to drive the squalene into the pores of the carbon. After about 15-20 minutes, the vessel was opened and the supercritical fluid sublimed. The non-volatile squalene was present on the surface and within the pores of the activated carbon.

C. 43% Squalene on Pica G-277 Carbon, Carbon Dioxide Treated

The surface-modified adsorbent was produced using the same procedure as above in (A), except using 73 mg of squalene starting material.

D. Adsorption Profiles

About 50 mg of the surface-modified adsorbents were placed in a plug-space-plug filter of a 1R4F reference cigarette smoked in a smoking machine, and the levels of various constituents in the mainstream smoke of the cigarette were measured using a GC-mass spectrometer. The surface-modified adsorbents were measured relative to a control containing about 50 mg of Pica G-277 carbon.

The results of the experiments are summarized in Tables 1 through 16, below. The percentage total delivery is given with respect to a 1R4F reference cigarette. The average standard deviation is given as % Rsd.

TABLE 1

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| hydrogen cyanide puff 1 | 0 | 0 | 0 | 32% | 0 | 1 | 1 | 21% |
| hydrogen cyanide puff 2 | 1 | 1 | 1 | 4% | 1 | 2 | 1 | 64% |

TABLE 1-continued

| | | | | | | | | |
|---|---|---|---|---|---|---|---|---|
| hydrogen cyanide puff 3 | 2 | 2 | 2 | 12% | 1 | 3 | 2 | 60% |
| hydrogen cyanide puff 4 | 3 | 3 | 3 | 7% | 2 | 5 | 3 | 57% |
| hydrogen cyanide puff 5 | 3 | 3 | 3 | 7% | 3 | 7 | 5 | 53% |
| hydrogen cyanide puff 6 | 4 | 3 | 4 | 9% | 4 | 7 | 5 | 41% |
| hydrogen cyanide puff 7 | 4 | 4 | 4 | 2% | 2 | 7 | 5 | 84% |
| hydrogen cyanide puff 8 | 5 | 4 | 4 | 6% | 5 | 8 | 6 | 31% |
| % Total Delivery VS 1R4F | 22 | 21 | 22 | 3% | 18 | 39 | 29 | 52% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| hydrogen cyanide puff 1 | 0 | 1 | 1 | 44% | 0 | 1 | 1 | 24% |
| hydrogen cyanide puff 2 | 1 | 3 | 2 | 63% | 3 | 2 | 3 | 8% |
| hydrogen cyanide puff 3 | 2 | 4 | 3 | 62% | 5 | 4 | 4 | 12% |
| hydrogen cyanide puff 4 | 2 | 5 | 4 | 51% | 6 | 5 | 6 | 14% |
| hydrogen cyanide puff 5 | 3 | 6 | 4 | 34% | 7 | 6 | 7 | 11% |
| hydrogen cyanide puff 6 | 4 | 6 | 5 | 32% | 7 | 8 | 7 | 3% |
| hydrogen cyanide puff 7 | 3 | 7 | 5 | 55% | 8 | 9 | 8 | 10% |
| hydrogen cyanide puff 8 | 6 | 8 | 7 | 24% | 12 | 9 | 10 | 24% |
| % Total Delivery VS 1R4F | 21 | 39 | 30 | 42% | 48 | 43 | 46 | 8% |

TABLE 2

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| ethane puff 1 | 3 | 3 | 3 | 17% | 3 | 4 | 3 | 25% |
| ethane puff 2 | 7 | 7 | 7 | 3% | 7 | 11 | 9 | 34% |
| ethane puff 3 | 12 | 12 | 12 | 4% | 8 | 12 | 10 | 27% |
| ethane puff 4 | 14 | 12 | 13 | 11% | 9 | 15 | 12 | 32% |
| ethane puff 5 | 14 | 14 | 14 | 1% | 13 | 14 | 13 | 4% |
| ethane puff 6 | 16 | 16 | 16 | 1% | 9 | 12 | 11 | 23% |
| ethane puff 7 | 16 | 20 | 18 | 16% | 18 | 15 | 16 | 13% |
| ethane puff 8 | 17 | 22 | 20 | 19 | 14 | 14 | 14 | 2% |
| % Total Delivery VS 1R4F | 99 | 106 | 103 | 5% | 81 | 98 | 89 | 13% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| ethane puff 1 | 3 | 2 | 3 | 30% | 2 | 5 | 4 | 53% |
| ethane puff 2 | 8 | 8 | 8 | 4% | 8 | 8 | 8 | 4% |
| ethane puff 3 | 10 | 12 | 11 | 15% | 11 | 11 | 11 | 1% |
| ethane puff 4 | 10 | 13 | 12 | 16% | 13 | 10 | 11 | 20% |
| ethane puff 5 | 14 | 13 | 13 | 3% | 12 | 11 | 12 | 5% |
| ethane puff 6 | 13 | 13 | 13 | 2% | 13 | 13 | 13 | 1% |
| ethane puff 7 | 13 | 13 | 13 | 1% | 15 | 11 | 13 | 21% |
| ethane puff 8 | 14 | 14 | 14 | 1% | 15 | 13 | 14 | 9% |
| % Total Delivery VS 1R4F | 85 | 89 | 87 | 3% | 89 | 82 | 85 | 6% |

TABLE 3

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| propadiene puff 1 | 3 | 5 | 4 | 46% | 6 | 10 | 8 | 29% |
| propadiene puff 2 | 4 | 4 | 4 | 4% | 9 | 14 | 11 | 38% |

TABLE 3-continued

| | | | | | | | | |
|---|---|---|---|---|---|---|---|---|
| propadiene puff 3 | 4 | 4 | 4 | 3% | 7 | 9 | 8 | 17% |
| propadiene puff 4 | 6 | 4 | 5 | 22% | 6 | 9 | 8 | 37% |
| propadiene puff 5 | 6 | 5 | 6 | 18% | 6 | 10 | 8 | 31% |
| propadiene puff 6 | 8 | 7 | 8 | 17% | 5 | 8 | 7 | 28% |
| propadiene puff 7 | 10 | 8 | 9 | 17% | 6 | 10 | 8 | 40% |
| propadiene puff 8 | 11 | 8 | 10 | 21% | 7 | 11 | 9 | 35% |
| % Total Delivery VS 1R4F | 52 | 44 | 48 | 11% | 53 | 80 | 66 | 29% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| propadiene puff 1 | 7 | 12 | 10 | 39% | 24 | 21 | 22 | 8% |
| propadiene puff 2 | 10 | 13 | 12 | 19% | 14 | 12 | 13 | 12% |
| propadiene puff 3 | 9 | 10 | 9 | 6% | 7 | 7 | 7 | 5% |
| propadiene puff 4 | 9 | 10 | 9 | 12% | 8 | 6 | 7 | 22% |
| propadiene puff 5 | 9 | 9 | 9 | 5% | 6 | 7 | 7 | 3% |
| propadiene puff 6 | 8 | 9 | 9 | 8% | 8 | 8 | 8 | 3% |
| propadiene puff 7 | 8 | 11 | 9 | 16% | 9 | 7 | 8 | 16% |
| propadiene puff 8 | 10 | 11 | 10 | 7% | 10 | 8 | 9 | 20% |
| % Total Delivery VS 1R4F | 70 | 86 | 78 | 14% | 86 | 75 | 81 | 10% |

TABLE 4

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| 1,3-butadiene puff 1 | 1 | 2 | 1 | 58% | 1 | 2 | 2 | 62% |
| 1,3-butadiene puff 2 | 1 | 1 | 1 | 50% | 1 | 3 | 2 | 71% |
| 1,3-butadiene puff 3 | 1 | 1 | 1 | 53% | 1 | 2 | 2 | 60% |
| 1,3-butadiene puff 4 | 1 | 1 | 1 | 7% | 1 | 3 | 2 | 64% |
| 1,3-butadiene puff 5 | 1 | 1 | 1 | 36% | 2 | 4 | 3 | 50% |
| 1,3-butadiene puff 6 | 1 | 2 | 1 | 33% | 2 | 4 | 3 | 41% |
| 1,3-butadiene puff 7 | 1 | 2 | 2 | 17% | 3 | 5 | 4 | 46% |
| 1,3-butadiene puff 8 | 2 | 2 | 2 | 14% | 4 | 7 | 5 | 37% |
| % Total Delivery VS 1R4F | 8 | 13 | 10 | 32% | 14 | 30 | 22 | 50% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| 1,3-butadiene puff 1 | 1 | 3 | 2 | 53% | 11 | 10 | 10 | 12% |
| 1,3-butadiene puff 2 | 1 | 2 | 2 | 54% | 9 | 8 | 9 | 8% |
| 1,3-butadiene puff 3 | 1 | 2 | 2 | 52% | 7 | 6 | 7 | 8% |
| 1,3-butadiene puff 4 | 1 | 3 | 2 | 53% | 8 | 6 | 7 | 19% |
| 1,3-butadiene puff 5 | 2 | 3 | 3 | 37% | 7 | 7 | 7 | 1% |
| 1,3-butadiene puff 6 | 2 | 4 | 3 | 36% | 10 | 10 | 10 | 1% |
| 1,3-butadiene puff 7 | 3 | 5 | 4 | 25% | 11 | 9 | 10 | 19% |
| 1,3-butadiene puff 8 | 4 | 6 | 5 | 26% | 12 | 10 | 11 | 14% |
| % Total Delivery VS 1R4F | 16 | 27 | 22 | 37% | 75 | 65 | 70 | 10% |

TABLE 5

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| isoprene puff 1 | 0 | 1 | 0 | 50% | 0 | 1 | 0 | 29% |
| isoprene puff 2 | 0 | 1 | 0 | 47% | 0 | 1 | 0 | 46% |

TABLE 5-continued

| | | | | | | | | |
|---|---|---|---|---|---|---|---|---|
| isoprene puff 3 | 0 | 1 | 0 | 55% | 0 | 0 | 0 | 26% |
| isoprene puff 4 | 1 | 1 | 1 | 22% | 0 | 2 | 1 | 74% |
| isoprene puff 5 | 1 | 1 | 1 | 39% | 1 | 2 | 1 | 64% |
| isoprene puff 6 | 1 | 2 | 1 | 28% | 1 | 2 | 1 | 62% |
| isoprene puff 7 | 1 | 2 | 1 | 13% | 1 | 3 | 2 | 67% |
| isoprene puff 8 | 1 | 2 | 2 | 20% | 1 | 4 | 3 | 76% |
| % Total Delivery VS 1R4F | 6 | 9 | 8 | 28% | 5 | 14 | 9 | 64% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| isoprene puff 1 | 0 | 1 | 1 | 28% | 3 | 2 | 3 | 10% |
| isoprene puff 2 | 0 | 1 | 1 | 32% | 4 | 3 | 3 | 10% |
| isoprene puff 3 | 0 | 1 | 0 | 46% | 3 | 2 | 3 | 15% |
| isoprene puff 4 | 1 | 2 | 2 | 62% | 9 | 7 | 8 | 20% |
| isoprene puff 5 | 1 | 2 | 2 | 49% | 9 | 8 | 9 | 11% |
| isoprene puff 6 | 1 | 2 | 2 | 43% | 11 | 11 | 11 | 3% |
| isoprene puff 7 | 2 | 3 | 2 | 38% | 12 | 12 | 12 | 3% |
| isoprene puff 8 | 2 | 3 | 3 | 17% | 13 | 14 | 14 | 5% |
| % Total Delivery VS 1R4F | 8 | 15 | 11 | 38% | 63 | 60 | 62 | 4% |

TABLE 6

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| formaldehyde puff 1 | 15 | 23 | 19 | 30% | 12 | 33 | 23 | 65% |
| formaldehyde puff 2 | 6 | 6 | 6 | 8% | 6 | 15 | 10 | 63% |
| formaldehyde puff 3 | 2 | 4 | 3 | 41% | 3 | 4 | 3 | 12% |
| formaldehyde puff 4 | 3 | 2 | 3 | 23% | 2 | 3 | 2 | 31% |
| formaldehyde puff 5 | 2 | 2 | 2 | 14% | 2 | 2 | 2 | 17% |
| formaldehyde puff 6 | 2 | 2 | 2 | 18% | 2 | 1 | 2 | 30% |
| formaldehyde puff 7 | 2 | 3 | 2 | 31% | 2 | 1 | 2 | 28% |
| formaldehyde puff 8 | 1 | 1 | 1 | 9% | 1 | 2 | 1 | 77% |
| % Total Delivery VS 1R4F | 33 | 44 | 38 | 21% | 29 | 60 | 45 | 49% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| formaldehyde puff 1 | 15 | 23 | 19 | 30% | 53 | 33 | 43 | 32% |
| formaldehyde puff 2 | 6 | 7 | 7 | 12% | 13 | 10 | 11 | 15% |
| formaldehyde puff 3 | 2 | 4 | 3 | 40% | 6 | 4 | 5 | 28% |
| formaldehyde puff 4 | 3 | 3 | 3 | 2% | 3 | 3 | 3 | 12% |
| formaldehyde puff 5 | 2 | 3 | 2 | 7% | 3 | 1 | 2 | 56% |
| formaldehyde puff 6 | 3 | 1 | 2 | 60% | 2 | 2 | 2 | 23% |
| formaldehyde puff 7 | 2 | 2 | 2 | 30% | 2 | 2 | 2 | 16% |
| formaldehyde puff 8 | 3 | 1 | 2 | 64% | 3 | 1 | 2 | 65% |
| % Total Delivery VS 1R4F | 36 | 43 | 40 | 13% | 85 | 56 | 70 | 29% |

55

TABLE 7

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| acetaldehyde puff 1 | 1 | 2 | 1 | 62% | 1 | 2 | 2 | 57% |
| acetaldehyde puff 2 | 1 | 2 | 2 | 28% | 3 | 5 | 4 | 37% |

TABLE 7-continued

| | | | | | | | | |
|---|---|---|---|---|---|---|---|---|
| acetaldehyde puff 3 | 2 | 2 | 2 | 12% | 4 | 6 | 5 | 31% |
| acetaldehyde puff 4 | 3 | 2 | 2 | 11% | 4 | 8 | 6 | 43% |
| acetaldehyde puff 5 | 3 | 3 | 3 | 2% | 6 | 10 | 8 | 36% |
| acetaldehyde puff 6 | 4 | 4 | 4 | 8% | 7 | 10 | 9 | 23% |
| acetaldehyde puff 7 | 5 | 5 | 5 | 6% | 9 | 12 | 10 | 20% |
| acetaldehyde puff 8 | 7 | 6 | 7 | 10% | 11 | 14 | 13 | 14% |
| % Total Delivery VS 1R4F | 26 | 26 | 26 | 1% | 45 | 66 | 56 | 27% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| acetaldehyde puff 1 | 1 | 2 | 2 | 15% | 6 | 6 | 6 | 1% |
| acetaldehyde puff 2 | 3 | 3 | 3 | 21% | 7 | 7 | 7 | 1% |
| acetaldehyde puff 3 | 4 | 5 | 5 | 20% | 9 | 7 | 8 | 14% |
| acetaldehyde puff 4 | 5 | 7 | 6 | 15% | 10 | 8 | 9 | 17% |
| acetaldehyde puff 5 | 7 | 8 | 8 | 8% | 9 | 9 | 9 | 3% |
| acetaldebyde puff 6 | 8 | 9 | 9 | 4% | 11 | 11 | 11 | 1% |
| acetaldehyde puff 7 | 10 | 11 | 10 | 4% | 13 | 11 | 12 | 11% |
| acetaldehyde puff 8 | 12 | 13 | 13 | 6% | 16 | 12 | 14 | 16% |
| % Total Delivery VS 1R4F | 51 | 58 | 54 | 9% | 81 | 71 | 76 | 9% |

TABLE 8

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| acrolein puff 1 | 0 | 1 | 1 | 71% | 0 | 1 | 1 | 38% |
| acrolein puff 2 | 0 | 1 | 0 | 57% | 0 | 1 | 1 | 60% |
| acrolein puff 3 | 0 | 1 | 0 | 73% | 1 | 1 | 1 | 29% |
| acrolein puff 4 | 0 | 1 | 1 | 54% | 0 | 1 | 1 | 141% |
| acrolein puff 5 | 1 | 1 | 1 | 4% | 1 | 1 | 1 | 25% |
| acrolein puff 6 | 2 | 1 | 1 | 11% | 1 | 2 | 1 | 25% |
| acrolein puff 7 | 1 | 1 | 1 | 31% | 1 | 3 | 2 | 68% |
| acrolein puff 8 | 1 | 2 | 2 | 30% | 2 | 4 | 3 | 58% |
| % Total Delivery VS 1R4F | 6 | 8 | 7 | 28% | 6 | 14 | 10 | 55% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| acrolein puff 1 | 0 | 0 | 0 | 2% | 4 | 3 | 4 | 13% |
| acrolein puff 2 | 0 | 0 | 0 | 6% | 5 | 4 | 4 | 12% |
| acrolein puff 3 | 0 | 1 | 1 | 61% | 5 | 4 | 5 | 16% |
| acrolein puff 4 | 1 | 1 | 1 | 27% | 7 | 4 | 5 | 29% |
| acrolein puff 5 | 1 | 2 | 1 | 56% | 7 | 7 | 7 | 1% |
| acrolein puff 6 | 2 | 3 | 2 | 49% | 8 | 8 | 8 | 8% |
| acrolein puff 7 | 2 | 3 | 2 | 38% | 10 | 8 | 9 | 12% |
| acrolein puff 8 | 2 | 4 | 3 | 41% | 11 | 9 | 10 | 16% |
| % Total Delivery VS 1R4F | 8 | 15 | 11 | 41% | 56 | 47 | 51 | 13% |

TABLE 9

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| diacetyl puff 1 | 0 | 1 | 1 | 57% | 0 | 1 | 0 | 34% |
| diacetyl puff 2 | 1 | 1 | 1 | 28% | 0 | 1 | 1 | 38% |

TABLE 9-continued

| | | | | | | | | |
|---|---|---|---|---|---|---|---|---|
| diacetyl puff 3 | 1 | 1 | 1 | 40% | 0 | 1 | 1 | 50% |
| diacetyl puff 4 | 1 | 1 | 1 | 22% | 1 | 1 | 1 | 66% |
| diacetyl puff 5 | 1 | 1 | 1 | 26% | 1 | 2 | 1 | 60% |
| diacetyl puff 6 | 1 | 1 | 1 | 27% | 1 | 2 | 1 | 54% |
| diacetyl puff 7 | 1 | 2 | 1 | 45% | 1 | 2 | 2 | 49% |
| diacetyl puff 8 | 1 | 2 | 1 | 19% | 1 | 2 | 2 | 58% |
| % Total Delivery VS 1R4F | 6 | 10 | 8 | 31% | 5 | 11 | 8 | 54% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| diacetyl puff 1 | 00 | 1 | 1 | 22% | 1 | 2 | 1 | 17% |
| diacetyl puff 2 | 1 | 1 | 1 | 14% | 3 | 3 | 3 | 1% |
| diacetyl puff 3 | 1 | 1 | 1 | 47% | 4 | 4 | 4 | 6% |
| diacetyl puff 4 | 1 | 1 | 1 | 47% | 5 | 5 | 5 | 9% |
| diacetyl puff 5 | 1 | 1 | 1 | 32% | 5 | 5 | 5 | 1% |
| diacetyl puff 6 | 1 | 2 | 1 | 29% | 6 | 6 | 6 | 8% |
| diacetyl puff 7 | 1 | 2 | 1 | 20% | 8 | 6 | 7 | 13% |
| diacetyl puff 8 | 1 | 2 | 2 | 24% | 8 | 7 | 8 | 11% |
| % Total Delivery VS 1R4F | 7 | 11 | 9 | 29% | 42 | 38 | 40 | 7% |

TABLE 10

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| benzene puff 1 | 0 | 1 | 1 | 56% | 1 | 1 | 1 | 21% |
| benzene puff 2 | 0 | 1 | 1 | 39% | 0 | 1 | 1 | 59% |
| benzene puff 3 | 0 | 1 | 1 | 51% | 0 | 1 | 1 | 63% |
| benzene puff 4 | 1 | 1 | 1 | 23% | 0 | 1 | 1 | 73% |
| benzene puff 5 | 1 | 1 | 1 | 31% | 0 | 1 | 1 | 65% |
| benzene puff 6 | 1 | 1 | 1 | 33% | 0 | 1 | 1 | 62% |
| benzene puff 7 | 1 | 1 | 1 | 36% | 1 | 1 | 1 | 62% |
| benzene puff 8 | 1 | 1 | 1 | 24% | 1 | 2 | 1 | 72% |
| % Total Delivery VS 1R4F | 5 | 8 | 7 | 35% | 4 | 9 | 6 | 61% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| benzene puff 1 | 1 | 1 | 1 | 44% | 2 | 2 | 2 | 0% |
| benzene puff 2 | 1 | 1 | 1 | 39% | 3 | 3 | 3 | 12% |
| benzene puff 3 | 0 | 1 | 1 | 59% | 4 | 3 | 3 | 16% |
| benzene puff 4 | 1 | 1 | 1 | 53% | 4 | 4 | 4 | 14% |
| benzene puff 5 | 1 | 1 | 1 | 43% | 4 | 4 | 4 | 2% |
| benzene puff 6 | 1 | 1 | 1 | 37% | 5 | 5 | 5 | 1% |
| benzene puff 7 | 1 | 1 | 1 | 31% | 6 | 6 | 6 | 3% |
| benzene puff 8 | 1 | 2 | 1 | 26% | 8 | 7 | 7 | 10% |
| % Total Delivery VS 1R4F | 5 | 10 | 7 | 40% | 36 | 32 | 34 | 7% |

55

TABLE 11

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| toluene puff 1 | 0 | 0 | 0 | 40% | 1 | 0 | 0 | 40% |
| toluene puff 2 | 0 | 1 | 1 | 42% | 0 | 1 | 1 | 27% |

TABLE 11-continued

| | | | | | | | | |
|---|---|---|---|---|---|---|---|---|
| toluene puff 3 | 1 | 1 | 1 | 47% | 0 | 1 | 1 | 50% |
| toluene puff 4 | 1 | 1 | 1 | 49% | 0 | 1 | 1 | 52% |
| toluene puff 5 | 1 | 1 | 1 | 20% | 0 | 1 | 1 | 62% |
| toluene puff 6 | 1 | 1 | 1 | 35% | 1 | 1 | 1 | 49% |
| toluene puff 7 | 1 | 2 | 1 | 39% | 1 | 1 | 1 | 60% |
| toluene puff 8 | 1 | 2 | 1 | 34% | 1 | 2 | 1 | 71% |
| % Total Delivery VS 1R4F | 5 | 9 | 7 | 38% | 4 | 8 | 6 | 49% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| toluene puff 1 | 0 | 0 | 0 | 22% | 0 | 0 | 0 | 15% |
| toluene puff 2 | 0 | 1 | 1 | 41% | 1 | 1 | 1 | 14% |
| toluene puff 3 | 0 | 1 | 1 | 52% | 2 | 2 | 2 | 14% |
| toluene puff 4 | 1 | 1 | 1 | 52% | 3 | 2 | 2 | 14% |
| toluene puff 5 | 1 | 1 | 1 | 50% | 3 | 3 | 3 | 9% |
| toluene puff 6 | 1 | 1 | 1 | 45% | 3 | 3 | 3 | 10% |
| toluene puff 7 | 1 | 1 | 1 | 29% | 4 | 4 | 4 | 1% |
| toluene puff 8 | 1 | 2 | 1 | 28% | 6 | 5 | 5 | 13% |
| % Total Delivery VS 1R4F | 5 | 9 | 7 | 40% | 23 | 20 | 21 | 10% |

TABLE 12

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| acrylonitrile puff 1 | 1 | 3 | 2 | 46% | 4 | 8 | 6 | 40% |
| acrylonitrile puff 2 | 2 | 6 | 4 | 68% | 7 | 7 | 7 | 8% |
| acrylonitrile puff 3 | 3 | 6 | 4 | 48% | 8 | 9 | 9 | 5% |
| acrylonitrile puff 4 | 3 | 6 | 4 | 38% | 7 | 13 | 10 | 45% |
| acrylonitrile puff 5 | 0 | 1 | 0 | 43% | 1 | 1 | 1 | 3% |
| acrylonitrile puff 6 | 1 | 1 | 1 | 36% | 1 | 1 | 1 | 64% |
| acrylonitrile puff 7 | 1 | 1 | 1 | 48% | 1 | 2 | 2 | 24% |
| acrylonitrile puff 8 | 1 | 2 | 1 | 34% | 1 | 3 | 2 | 63% |
| % Total Delivery VS 1R4F | 12 | 25 | 18 | 48% | 30 | 44 | 37 | 27% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| acrylonitrile puff 1 | 5 | 7 | 6 | 27% | 8 | 9 | 9 | 8% |
| acrylonitrile puff 2 | 7 | 8 | 8 | 13% | 11 | 10 | 11 | 2% |
| acrylonitrile puff 3 | 7 | 9 | 8 | 23% | 14 | 11 | 12 | 21% |
| acrylonitrile puff 4 | 7 | 15 | 11 | 52% | 14 | 12 | 13 | 10% |
| acrylonitrile puff 5 | 0 | 1 | 1 | 41% | 3 | 3 | 3 | 1% |
| acrylonitrile puff 6 | 1 | 1 | 1 | 22% | 4 | 4 | 4 | 8% |
| acrylonitrile puff 7 | 1 | 2 | 2 | 7% | 5 | 5 | 5 | 2% |
| acrylonitrile puff 8 | 1 | 2 | 2 | 27% | 10 | 6 | 8 | 36% |
| % Total Delivery VS 1R4F | 30 | 46 | 38 | 30% | 69 | 59 | 64 | 10% |

55

TABLE 13

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| methyl furan puff 1 | 0 | 0 | 0 | 51% | 0 | 0 | 0 | 6% |
| methyl furan puff 2 | 0 | 1 | 1 | 46% | 0 | 1 | 1 | 57% |

TABLE 13-continued

| | | | | | | | | |
|---|---|---|---|---|---|---|---|---|
| methyl furan puff 3 | 1 | 1 | 1 | 49% | 0 | 1 | 1 | 49% |
| methyl furan puff 4 | 1 | 1 | 1 | 16% | 1 | 1 | 1 | 54% |
| methyl furan puff 5 | 1 | 1 | 1 | 30% | 1 | 2 | 1 | 75% |
| methyl furan puff 6 | 1 | 2 | 1 | 30% | 1 | 2 | 1 | 66% |
| methyl furan puff 7 | 1 | 2 | 1 | 24% | 1 | 2 | 2 | 54% |
| methyl furan puff 8 | 1 | 2 | 2 | 24% | 1 | 3 | 2 | 67% |
| % Total Delivery VS 1R4F | 6 | 10 | 8 | 30% | 5 | 12 | 8 | 59% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| methyl furan puff 1 | 0 | 1 | 0 | 32% | 1 | 1 | 1 | 3% |
| methyl furan puff 2 | 1 | 1 | 1 | 21% | 3 | 3 | 3 | 19% |
| methyl furan puff 3 | 1 | 1 | 1 | 33% | 6 | 5 | 5 | 15% |
| methyl furan puff 4 | 1 | 1 | 1 | 46% | 7 | 6 | 6 | 11% |
| methyl furan puff 5 | 1 | 2 | 1 | 51% | 7 | 7 | 7 | 2% |
| methyl furan puff 6 | 1 | 2 | 1 | 44% | 9 | 8 | 9 | 6% |
| methyl furan puff 7 | 1 | 2 | 2 | 39% | 11 | 10 | 10 | 8% |
| methyl furan puff 8 | 2 | 2 | 2 | 29% | 12 | 11 | 11 | 6% |
| % Total Delivery VS 1R4F | 7 | 12 | 9 | 38% | 56 | 50 | 53 | 8% |

TABLE 14

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| hydrogen sulfide puff 1 | 0 | 0 | 0 | 38% | 0 | 0 | 0 | 4% |
| hydrogen sulfide puff 2 | 2 | 2 | 2 | 8% | 3 | 3 | 3 | 5% |
| hydrogen sulfide puff 3 | 2 | 3 | 2 | 26% | 3 | 4 | 3 | 31% |
| hydrogen sulfide puff 4 | 2 | 2 | 2 | 19% | 4 | 7 | 5 | 37% |
| hydrogen sulfide puff 5 | 3 | 3 | 3 | 3% | 5 | 8 | 7 | 36% |
| hydrogen sulfide puff 6 | 4 | 4 | 4 | 9% | 6 | 7 | 6 | 14% |
| hydrogen sulfide puff 7 | 5 | 4 | 4 | 11% | 7 | 8 | 8 | 11% |
| hydrogen sulfide puff 8 | 4 | 5 | 5 | 8% | 8 | 8 | 8 | 5% |
| % Total Delivery VS 1R4F | 22 | 22 | 22 | 0% | 35 | 45 | 40 | 17% |
| | 10% Squalene on 50 mg Pica G 277 SF $CO_2$ treated (55 mg) | | | | 43% Squalene on 50 mg Pica G 277 SF $CO_2$ treated (73 mg) | | | |
| | Run 1 | Run 2 | Avg. | % Rsd. | Run 1 | Run 2 | Avg. | % Rsd. |
| hydrogen sulfide puff 1 | 0 | 0 | 0 | 40% | 0 | 1 | 0 | 18% |
| hydrogen sulfide puff 2 | 2 | 3 | 2 | 28% | 4 | 4 | 4 | 17% |
| hydrogen sulfide puff 3 | 3 | 5 | 4 | 23% | 9 | 7 | 8 | 21% |
| hydrogen sulfide puff 4 | 5 | 6 | 5 | 7% | 10 | 7 | 8 | 23% |
| hydrogen sulfide puff 5 | 6 | 7 | 7 | 3% | 9 | 9 | 9 | 2% |
| hydrogen sulfide puff 6 | 7 | 7 | 7 | 2% | 9 | 11 | 10 | 14% |
| hydrogen sulfide puff 7 | 9 | 8 | 8 | 7% | 13 | 10 | 12 | 18% |
| hydrogen sulfide puff 8 | 10 | 10 | 10 | 4% | 13 | 11 | 12 | 11% |
| % Total Delivery VS 1R4F | 43 | 45 | 44 | 3% | 68 | 59 | 64 | 10% |

55

TABLE 15

| | 50 mg Pica G-277 Carbon Control, PSP in a 1R4F | | | | 10% Squalene on 50 mg Pica G 277, hexane treated (55 mg) | | | |
|---|---|---|---|---|---|---|---|---|
| | Run 1 | Run 2 | Avg. | % Rsd. | Run 1 | Run 2 | Avg. | % Rsd. |
| carbonyl sulfide puff 1 | 1 | 2 | 1 | 41% | 2 | 3 | 3 | 23% |
| carbonyl sulfide puff 2 | 3 | 4 | 4 | 12% | 7 | 8 | 7 | 16% |

TABLE 15-continued

| | | | | | | | | |
|---|---|---|---|---|---|---|---|---|
| carbonyl sulfide puff 3 | 5 | 6 | 6 | 13% | 8 | 9 | 9 | 12% |
| carbonyl sulfide puff 4 | 8 | 6 | 7 | 11% | 9 | 13 | 11 | 28% |
| carbonyl sulfide puff 5 | 9 | 8 | 8 | 4% | 9 | 13 | 11 | 23% |
| carbonyl sulfide puff 6 | 12 | 10 | 11 | 9% | 10 | 11 | 10 | 9% |
| carbonyl sulfide puff 7 | 14 | 12 | 13 | 10% | 10 | 14 | 12 | 19% |
| carbonyl sulfide puff 8 | 14 | 12 | 13 | 8% | 11 | 13 | 12 | 9% |
| % Total Delivery VS 1R4F | 65 | 61 | 63 | 4% | 66 | 84 | 75 | 17% |

| | 10% Squalene on 50 mg Pica G 277 SF $CO_2$ treated (55 mg) | | | | 43% Squalene on 50 mg Pica G 277 SF $CO_2$ treated (73 mg) | | | |
|---|---|---|---|---|---|---|---|---|
| | Run 1 | Run 2 | Avg. | % Rsd. | Run 1 | Run 2 | Avg. | % Rsd. |
| carbonyl sulfide puff 1 | 2 | 3 | 3 | 18% | 5 | 5 | 5 | 4% |
| carbonyl sulfide puff 2 | 6 | 7 | 7 | 13% | 8 | 8 | 8 | 7% |
| carbonyl sulfide puff 3 | 8 | 10 | 9 | 15% | 10 | 8 | 9 | 14% |
| carbonyl sulfide puff 4 | 10 | 11 | 10 | 9% | 11 | 8 | 9 | 20% |
| carbonyl sulfide puff 5 | 11 | 12 | 11 | 8% | 10 | 10 | 10 | 5% |
| carbonyl sulfide puff 6 | 12 | 12 | 12 | 2% | 11 | 13 | 12 | 13% |
| carbonyl sulfide puff 7 | 13 | 13 | 13 | 0% | 14 | 12 | 13 | 10% |
| carbonyl sulfide puff 8 | 15 | 15 | 15 | 0% | 15 | 13 | 14 | 13% |
| % Total Delivery VS 1R4F | 77 | 84 | 80 | 6% | 84 | 78 | 81 | 6% |

TABLE 16

Summary of Percentage Reduction of Various Compounds Using Surface-Modified Adsorbents (rounded to nearest 5%)

| | 50 mg Pica G-277 Carbon Control, PSP in a 1R4F | 10% Squalene on 50 mg Pica G277, $CO_2$ treated | 10% Squalene on 50 mg Pica G277 SF Hexane treated | 43% Squalene on 50 mg Pica G277 SF $CO_2$ treated |
|---|---|---|---|---|
| hydrogen cyanide | 80 | 60 | 70 | 55 |
| ethane | 0 | 10 | 15 | 15 |
| propadiene | 50 | 35 | 20 | 20 |
| 1,3-butadiene | 90 | 80 | 80 | 30 |
| isoprene | >90 | >90 | >90 | 40 |
| formaldehyde | 60 | 55 | 60 | 30 |
| acetaldehyde | 75 | 45 | 45 | 25 |
| acrolein | >90 | >90 | >90 | 50 |
| diacetyl | >90 | >90 | >90 | 60 |
| benzene | >90 | >90 | >90 | 65 |
| toluene | >90 | >90 | >90 | 80 |
| acrylonitrile | 80 | 75 | 60 | 35 |
| methyl furan | >90 | >90 | >90 | 45 |
| hydrogen sulfide | 80 | 60 | 55 | 35 |
| carbonyl sulfide | 40 | 25 | 20 | 20 |

Figure 9:
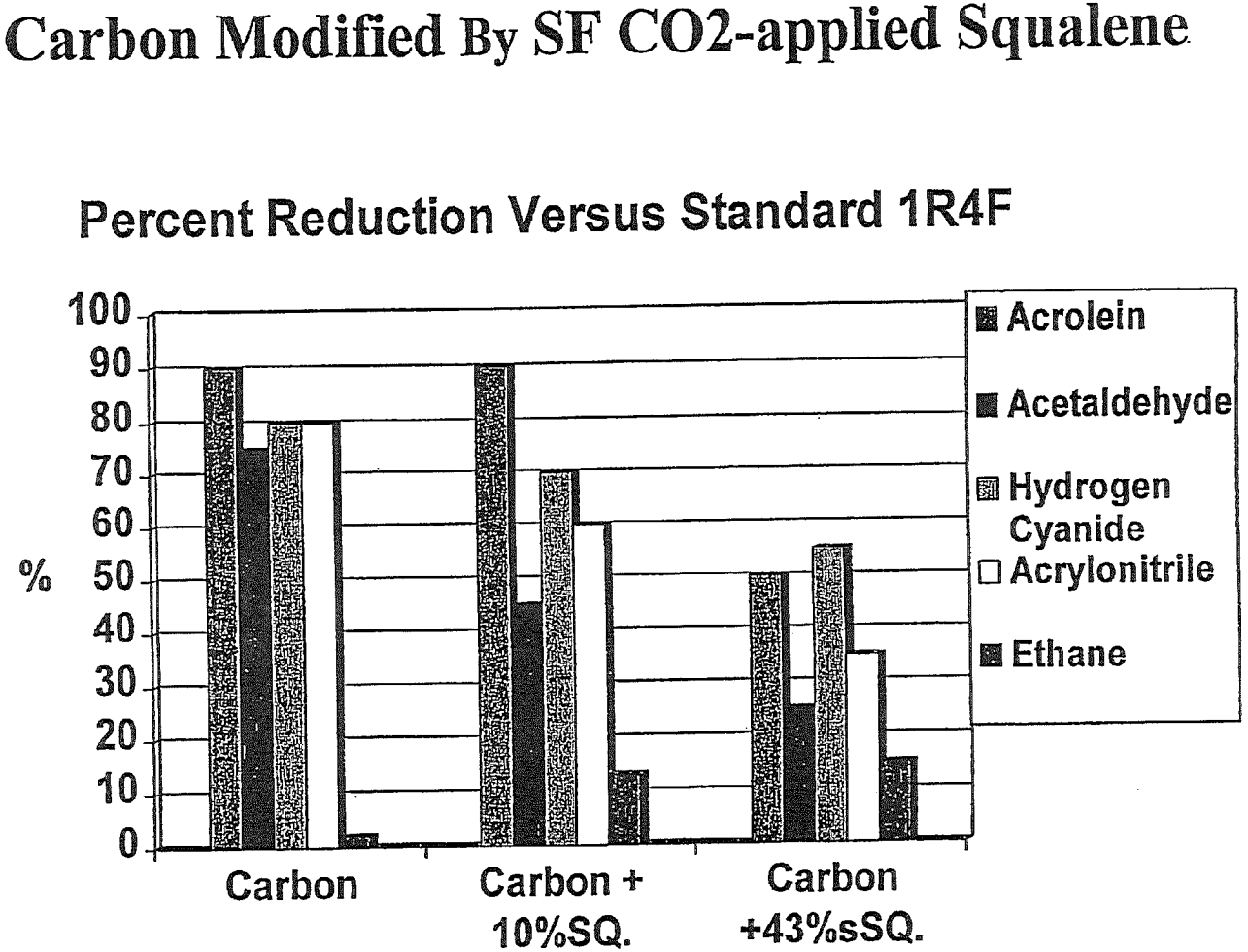
FIG. 9 is comparison of the selectivity of two surface-modified adsorbents in removing various components from mainstream smoke.

A comparison of some of the constituents is shown in FIG. 9 as well. As depicted, the control is compared against both the 10% squalene on Pica G-277 carbon that was carbon dioxide treated and the 43% squalene on Pica G-277 carbon that was carbon dioxide treated. As shown by the chart, preferential selection of acrolein over acetaldehyde and hydrogen cyanide over acrylonitrile is achieved through the use of the surface-modified adsorbents. In addition, increased adsorption of ethane is achieved by using the surface-modified adsorbents, as compared to the untreated carbon.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A process for making a surface-modified adsorbent, said process comprising:

(i) providing at least one adsorbent in particulate form and at least one non-volatile organic compound to a vessel;

(ii) adjusting temperature and/or pressure to provide supercritical conditions in said vessel for a supercritical fluid; and (iii) introducing the supercritical fluid into the vessel, such that the supercritical fluid dissolves the non-volatile organic compound, and wherein the supercritical fluid with the dissolved non-volatile organic compound impregnates the adsorbent to form surface-modified adsorbent particles, wherein the adsorbent comprises activated carbon, and wherein the non-volatile organic compound is selected from the group consisting of: squalene, squalane, phytol, and mixtures thereof.

2. The process of claim 1, wherein the activated carbon comprises at least about 80% micropores.

3. The process of claim 2, wherein the micropores have pore sizes of about 15 Angstroms or less.

4. The process of claim 1, wherein the activated carbon has an average particle size from about 6 mesh to about 300 mesh.

5. The process of claim 1, wherein the activated carbon has an average particle size from about 0.2 mm to about 1 mm.

6. The process of claim 1, wherein the supercritical fluid is selected from the group consisting of: carbon dioxide, n-propane, n-butane, n-pentane, n-hexane, n-heptane, cyclohexane, ethanol, toluene, acetone, methyl acetate, diethyl ether, dichloromethane, dichlorodifluoromethane, trifluoromethane, carbon tetrachloride and mixtures thereof.

7. The process of claim 6, wherein the supercritical fluid is carbon dioxide.

8. The process of claim 1, wherein the non-volatile compound is capable of blocking pores in the adsorbent having an average size greater than about 20 Angstroms.

9. The process of claim 8, wherein the non-volatile compound is capable of blocking pores in the adsorbent having an average size greater than about 10 Angstroms.

10. A process for making a surface-modified adsorbent, said process comprising:

(i) providing particles of activated carbon adsorbent and at least one non-volatile organic compound to a vessel;

(ii) adjusting temperature and/or pressure to provide supercritical conditions in said vessel for carbon dioxide; and (iii) introducing supercritical carbon dioxide into the vessel, such that the supercritical fluid dissolves the non-volatile organic compound, and wherein the supercritical fluid with the dissolved non-volatile organic compound impregnates the particles of activated carbon to form a surface-modified adsorbent, wherein the non-volatile organic compound is selected from the group consisting of squalene, squalane, phytol, and mixtures thereof.

11. A process of making a cigarette filter, comprising:

(a) preparing a surface-modified adsorbent by the process of claim 1; and (b) incorporating the surface-modified adsorbent into a cigarette filter.

12. A process of making a cigarette, comprising:

(a) preparing a surface-modified adsorbent by the process of claim 1; and (b) incorporating the surface-modified adsorbent into a cigarette.

* * * * *